US009769891B2

(12) United States Patent
Baccarin et al.

(10) Patent No.: US 9,769,891 B2
(45) Date of Patent: Sep. 19, 2017

(54) LED DRIVER CIRCUIT, METHOD OF DRIVING AND VEHICLE LIGHT

(71) Applicant: Automotive Lighting Italia S.p.A. A Socio Unico, Turin (IT)

(72) Inventors: Davide Baccarin, Turin (IT); Andrea Englaro, Turin (IT)

(73) Assignee: Automotive Lighting Italia S.p.A. a Socio Unico, Turin (IT)

( * ) Notice: Subject to any disclaimer, the term of this patent is extended or adjusted under 35 U.S.C. 154(b) by 812 days.

(21) Appl. No.: 13/757,492

(22) Filed: Feb. 1, 2013

(65) Prior Publication Data

US 2014/0021860 A1 Jan. 23, 2014

(30) Foreign Application Priority Data

Feb. 1, 2012 (IT) ..... PD2012A0025

(51) Int. Cl.
*H05B 33/08* (2006.01)

(52) U.S. Cl.
CPC ..... *H05B 33/083* (2013.01); *H05B 33/0824* (2013.01); *H05B 33/0845* (2013.01)

(58) Field of Classification Search
USPC ..... 315/291, 247, 185 S, 307–326, 209 R, 315/224, 225
IPC ..... H05B 41/2828,33/0845, 37/0218, 33/0827, 33/083, 33/0812, 33/0839
See application file for complete search history.

(56) References Cited

U.S. PATENT DOCUMENTS 8,569,974 B2 * 10/2013 Chobot ..... H05B 33/0866 315/149
8,618,737 B2 * 12/2013 Welten ..... 315/153
9,018,845 B2 * 4/2015 Ge ..... H05B 33/0815 315/192
2010/0109557 A1 * 5/2010 Bouchard ..... H05B 33/0818 315/294
2010/0181833 A1 * 7/2010 Wu ..... H05B 33/0815 307/36
2012/0223649 A1 * 9/2012 Saes ..... H05B 33/083 315/186
2012/0256550 A1 10/2012 Akiyama
(Continued)

FOREIGN PATENT DOCUMENTS

DE 9313820.2 U1 1/1994
DE 102006024607 A1 11/2007
(Continued)

OTHER PUBLICATIONS

Search Report issued by the Chinese Patent Office regarding Chinese Application No. 2013100424610 dated Nov. 19, 2015.

*Primary Examiner* — Tuyet Vo
(74) *Attorney, Agent, or Firm* — Howard & Howard Attorneys PLLC

(57) ABSTRACT

A driver circuit of lighting sources for powering a plurality of lighting sources, comprising switching means (20) which can be operated to modify the path of the overall power supply electric current crossing said lighting sources. Said switching means can be operated to switch the path of the overall power supply electric current between at least one first path, corresponding to a first circuit configuration of the interconnections between the lighting sources, and at least one second path, corresponding to a second circuit configuration of the interconnections between the lighting sources.

24 Claims, 10 Drawing Sheets

(56) References Cited

U.S. PATENT DOCUMENTS

| | | | | |
|---|---|---|---|---|
| 2012/0299492 | A1 | 11/2012 | Egawa et al. | |
| 2013/0127353 | A1* | 5/2013 | Athalye ..... | H05B 33/0815 315/193 |

FOREIGN PATENT DOCUMENTS

| | | | |
|---|---|---|---|
| EP | 2288234 | A1 | 2/2011 |
| WO | 2010013172 | A1 | 2/2010 |
| WO | WO2011077909 | A1 | 6/2011 |
| WO | WO2011096585 | | 8/2011 |

* cited by examiner

| M_CTRL_1 | M_CTRL_2 | LIVELLI |
|---|---|---|
| 0 | 0 | 2 |
| 1 | 0 | 3 |
| 0 | 1 | 4 |
| 1 | 1 | 6 |

LED DRIVER CIRCUIT, METHOD OF DRIVING AND VEHICLE LIGHT

CROSS-REFERENCE TO RELATED APPLICATIONS

This application claims the benefit of Italian Patent Application No. PD2012A000025, filed on Feb. 1, 2012, the disclosure of which is expressly incorporated herein by reference in its entirety.

BACKGROUND OF INVENTION

1. Field of the Invention

The present invention relates to a driver circuit for light sources, in particular LEDs, for a vehicle light.

2. Description of the Related Art

In some conditions of use of a driver circuit of lighting sources, it may happen that the power supply voltage of the circuit undergoes significant variations, and in particular falls well below the nominal value. In this case, if several light sources are connected in series with each other, it may then happen that the power supply voltage is insufficient to guarantee the correct lighting of all the sources.

Such a situation of a drop in the power supply voltage occurs for example when a vehicle turns off automatically when at a standstill, for example, at a traffic light, to then start again when the accelerator is pressed, using the system known as "Start and Stop". For example, during "Start and Stop", the power supply voltage may fall from a nominal value of 13.2 volts to 6.0 volts in the worst cases. Even in these operating conditions the vehicle light is required to have as little light fluctuation as possible. This means, that if an LED has a typical junction voltage of 2.5 volts, more than two LEDs cannot be connected in series with each other. Considering in fact the various physiological voltage drops of the circuit, the presence of an anti-inversion diode in input and the current regulation circuit, to drive three LEDs in series at least 9 volts would be needed. Under 9 volts, the luminosity begins to fall and, when the vehicle is stopped at the traffic lights and then starts again, the flickering of the LEDs may be noted.

In the driver circuits for light sources, in particular LEDs, normally used, the lighting sources are positioned in matrixes or in lighting branches, or in combinations thereof. An LED matrix is understood to mean a plurality of LEDs connected in a matrix, that is to say positioned in rows and columns, where the LEDs of each row are connected in parallel with each other. The matrix of LEDs is usually driven by a lighting switch and is therefore subject to a potential difference between a power supply terminal and a terminal of the lighting switch.

A lighting branch is typically understood to mean one or more lighting sources connected in series with each other. A lighting branch is usually driven by a lighting switch and is therefore subject to a potential difference between a power supply terminal and a terminal of the lighting switch.

In the continuation of the description, for simplicity's sake, a lighting branch will be understood not only as one or more lighting sources connected in series with each other, therefore crossed by the same power supply current, but also as the lighting sources belonging to the same column of an LED matrix.

The solutions adopted up till now to overcome such drawback is therefore that of using matrices with two rows of LEDs, instead of the three row LED matrices usually used, or lighting branches with two LEDs in series, instead of lighting branches with three LEDs in series.

This means that, for the same number of LEDs, a circuit needs to be designed with a greater number of columns of the LED matrix or of lighting branches connected in parallel to each other. Since in a current stabilised driver circuit a lighting branch always absorbs the same current, regardless of the number of LEDs, increasing the number of columns or lighting branches in parallel means increasing the current absorbed by the circuit.

For example, for the same lighting sources, passing from a three row matrix to a two row matrix means absorbing 50% more current and thereby dissipating 50% more power.

SUMMARY OF THE INVENTION

The object of the present invention is to provide a driver circuit for light sources, in particular LEDs for vehicle lights, able to overcome the drawbacks mentioned above with reference to the prior art.

In particular the present inventions sets out to provide a driver circuit able to guarantee optimal lighting of the light sources even at low power supply values and, at the same time, to limit the absorption of current and thereby the dissipation of power.

Such object is achieved by the circuit by the driving method and by the vehicle light of the present invention.

The driver circuit for the lighting sources of the present invention which includes a switch which can be operated to modify the path of the overall power supply electric current crossing the lighting sources. In particular, the switch can be operated to switch the path of the overall power supply electric current between at least one first path, corresponding to a first circuit configuration of the interconnections between the lighting sources, and at least one second path, corresponding to a second circuit configuration of the interconnections between the lighting sources.

In one embodiment, wherein the lighting sources are positioned on lighting branches, where a lighting branch includes lighting sources connected in series to each other or lighting sources belonging to a column of a matrix of lighting sources, the at least two circuit configurations have a different number of lighting branches.

In one embodiment, the step of modifying the power supply electric current is performed depending on the value of the direct voltage power supply. In particular, in the case of lowering of the power supply voltage, the switch is commanded in such a way as to increase the number of lighting branches. For the same number of lighting sources powered, this means reducing the number of lighting sources on each branch, and thereby ensuring the correct power supply even at low power supply voltages.

In the case of the power supply voltage returning to the nominal value, the switch is commanded in such a way as to reduce the number of lighting branches. For the same branch current, that is to say absorbed by each branch, of the different circuit configurations, this means reducing the overall current absorbed by the circuit, the number of branches being smaller and therefore the power dissipated compared to a conventional driver circuit.

In one embodiment, the switch can be operated to connect at least two lighting branches alternately in parallel or in series.

In particular, the switch can be operated to connect at least two branches of a first configuration of lighting branches, or parallel configuration, so as to obtain a second configuration, or series configuration, having a reduced number of lighting branches, and vice versa.

In a variation of one embodiment, the switch can be operated to connect the lighting sources of a lighting branch alternately in parallel or in series with the lighting sources of the other lighting branches.

In particular, the switch can be operated to connect lighting sources of a lighting branch of a first configuration, or parallel configuration, respectively to further lighting branches of said first configuration, so as to obtain a second configuration, or series configuration, having a reduced number of lighting branches, and vice versa.

It is to be noted that the term "parallel" is used in the present description not just to indicate a connection in parallel of electric components according to the known definition of electrical engineering, that is to say wherein components are connected to a pair of conductors in such a way that the electric voltage is applied to all the components in the same way, but also to indicate lighting branches or columns of matrices of LEDs placed between the power supply terminal and the lighting switch terminal/s.

BRIEF DESCRIPTION OF THE DRAWINGS

The features and advantages of the circuit and of the driving method according to the invention will, in any case, be evident from the description given below of its preferred embodiments, made by way of a non-limiting example with reference to the appended drawings, wherein.

DETAILED DESCRIPTION

Figure 1:
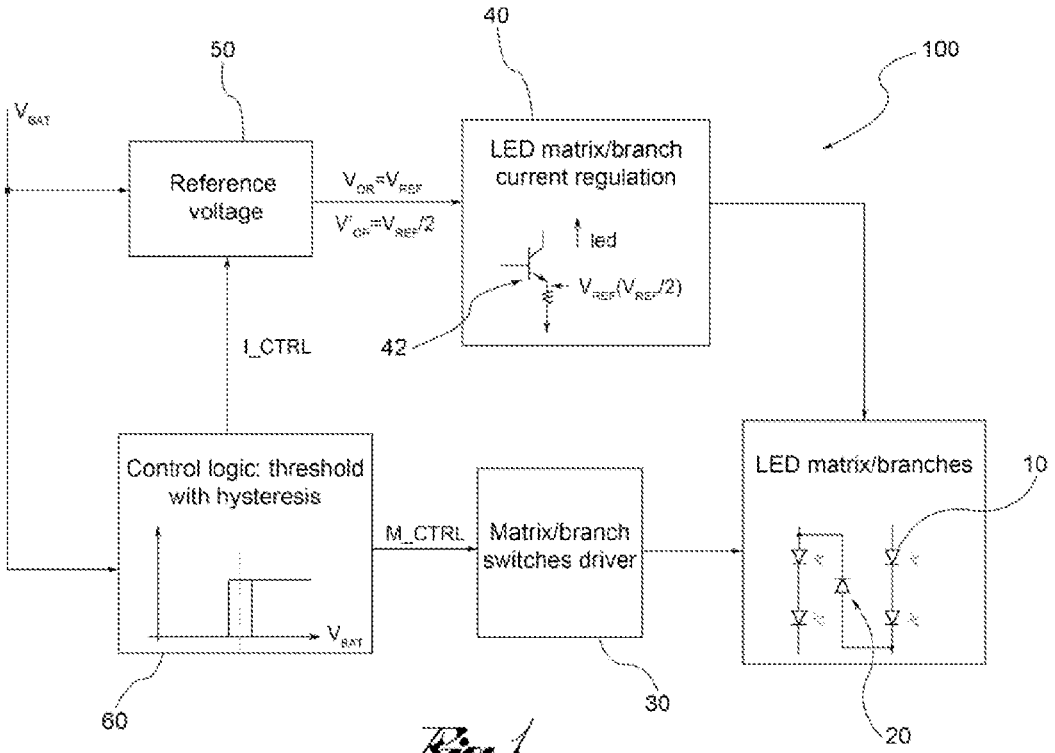
FIG. 1 is a block diagram of the driver circuit according to the invention.

In the following description, the term "connected" refers both to a direct electrical connection between two circuit elements and to an indirect connection by means of one or more active or passive intermediate elements. The term "circuit" may indicate either a single component or a plurality of components, active/or passive, connected to each other to achieve a predefined function. Moreover, where a bipolar junction transistor (BJT) or a field effect transistor (FET) can be used, the meaning of the terms "base", "collector", "emitter", include the terms "gate", "drain" and "source" and vice versa. Except as otherwise indicated, lastly, NPN type transistors may be used in place of PNP transistors and vice versa.

The driver circuit of lighting sources according to the invention, globally denoted by reference numeral 100; 100', will now be described with reference to the block diagrams in FIGS. 1 and 2. In these block diagrams, as also in the circuit diagrams below, the LEDs have been indicated as examples of possible lighting sources.

The circuit includes a power supply terminal which can be connected to a direct voltage power supply generator (Vbat). The power supply terminal powers a plurality of LEDs 10 positioned on one or more lighting branches. It is to be noted that the invention is equally applicable to both a matrix configuration of LEDs and to the case of LEDs in a single source/multi-source configuration.

In the continuation of the description, an LED matrix is understood to mean a plurality of LEDs connected in a matrix, that is to say positioned in rows, wherein the LEDs of each row are connected in parallel with each other. The matrix of LEDs may be driven by a lighting switch and is therefore subject to a potential difference between the power supply terminal and a terminal of the lighting switch.

A single source/multi-source configuration is understood to mean a plurality of LEDs positioned on several lighting branches connected in parallel to each other, wherein each of such may be driven by a respective lighting switch and is therefore subject to a potential difference between the power supply terminal and a terminal of the lighting switch, as may be clearly deduced from the description below. The LEDs of each lighting branch are connected in series with each other.

As mentioned above, in the continuation of the description, the term "parallel" is used not just to indicate a connection in parallel of electric components according to the known definition of electrical engineering, but also to indicate lighting branches or columns of matrices of LEDs placed between the power supply terminal and the lighting switch terminal/s.

As mentioned above, moreover, in the continuation of the description, a lighting "branch" will be understood as one or more lighting sources connected in series with each other or belonging to the same column of an LED matrix. Branch current (ILED) is consequently understood to mean the current crossing the lighting sources of a lighting branch. A driver current (IDRIVER) instead is understood to mean the current imposed by a lighting switch placed in cascade with a lighting branch or a matrix of LEDs. Power supply current is, lastly, understood to mean the overall current supplied by the driver circuit to power all the light sources and, therefore, all the lighting branches.

According to the invention, the circuit includes a switch 20 which can be operated to modify the path of the overall power supply electric current crossing said lighting sources. In a preferred embodiment, the switch 20 can be operated to switch the path of the overall power supply electric current between at least one first path, corresponding to a first circuit configuration, or "parallel" configuration of the interconnections between the lighting sources, and at least one second path, corresponding to a second circuit configuration, or "serial" configuration of the interconnections between the lighting sources.

In one embodiment, wherein the lighting sources are positioned on one or more lighting branches, according to the definition of lighting branch given above, the at least two circuit configurations have a different number of lighting branches.

In one embodiment, the switch 20 can be operated to modify the path of the current crossing the lighting sources depending on the direct voltage power supply value.

In other words, the switch 20 permits the configuration of the lighting branches to be modified so as to reduce or increase the number thereof depending on the power supply voltage, on the basis of a comparison of circuit signals, as will be specified below, keeping the number of lighting sources constant. In particular, for low values of the power supply voltage, the switch is activated to determine the path for the power supply current of the lighting sources which entails an increase in the number of lighting branches, and consequently a reduction of the number of lighting sources for each branch. Having reduced the number of lighting sources of each branch, the lighting sources may be correctly powered even by a low power supply voltage.

Vice versa, in the case of high power supply voltage values, the switch is activated to determine a different path of the power supply current, which entails a reduction in the number of lighting branches, and consequently an increase in the number of lighting sources for each branch. The branch current being determined solely by the current imposed on the lighting sources, to obtain the desired luminosity, reducing the number of such branches therefore means reducing the total power supply current required by the driver circuit and therefore the absorbed power.

In the continuation of the description, "serial configuration" will be taken to generally mean a configuration of the lighting branches which presents a smaller number of lighting branches compared to a "parallel configuration" which indicates instead a configuration of the lighting branches with a greater number of lighting branches.

In one embodiment which will be described in more detail below, the switch 20 can be operated to connect at least two lighting branches alternately in parallel or in series. Passing from the parallel configuration to the serial configuration therefore means reducing the number of lighting branches; passing, vice versa, from the serial configuration to the parallel configuration means increasing the number of lighting branches.

In another embodiment with at least three lighting branches, the switch 20 can be operated to connect the lighting sources 10 of a lighting branch of a first configuration, or parallel configuration, respectively to further lighting branches of said first configuration, so as to obtain a second configuration, or series configuration, having a reduced number of lighting branches, and vice versa. In this case, therefore starting for example from a parallel configuration with three lighting branches, one may pass to a serial configuration with two lighting branches connecting some of the lighting sources of a first branch in series to the lighting sources of a second branch and the remaining lighting sources of the first branch in series to the sources of the third branch. This way, in the serial configuration, the first lighting branch disappears and there is a power saving of 33%.

The switch 20 is commanded by the "Matrix/branch driver switches" 30 which include a command circuit, such as transistors, suitable for activating the switch 20 in the presence of a control signal M_CTRL.

Returning to the block diagram, the lighting branches are powered by means of the "LED matrix/branch current regulation" block 40. The block contains in other words, a circuit suitable for imposing in the lighting branches a branch current ILED required by the lighting sources to provide the desired luminosity, preferably a constant current in the case of a current stabilised driver circuit. In one embodiment, the circuit includes at least one lighting switch 42 connected at least to a respective lighting branch which can be operated to impose a driver current IDRIVER which translates into a constant branch current ILED through said lighting branch. Preferably, the driver current is dependent on a driver voltage (Vref) applied to the lighting switch 42. In one embodiment, the lighting switch 42 is a transistor.

As mentioned above, to obtain the benefits offered by the invention, the branch current circulating in the single lighting branch must remain the same both in the serial configuration and in the parallel configuration, regardless of the number of branches and of the number of lighting sources in each branch. In the case illustrated of a current stabilised driver circuit, the branch current is also constant. Since in the case of a parallel configuration of the lighting branches there is a greater absorption of overall current than in the serial configuration, the number of branches being greater, the driver current generated by the power supply switch must be greater in the case of a parallel configuration.

Consequently, the circuit also includes a "Voltage reference" block 50, including a driver voltage regulator suitable for regulating the value of the driver voltage Vref depending on the serial or parallel configuration of the lighting branches, so as to vary the driver current IDRIVER to keep the branch current ILED constant as said configuration varies.

The circuit further includes a "Control logic" block 60 that provides the "Matrix/branch switches driver" 30 with the matrix control signal M_CTRL and the "Voltage reference" block 50 with a current control signal I_CTRL to switch the value of the driver voltage to apply to the lighting switch/switches.

Figure 2:
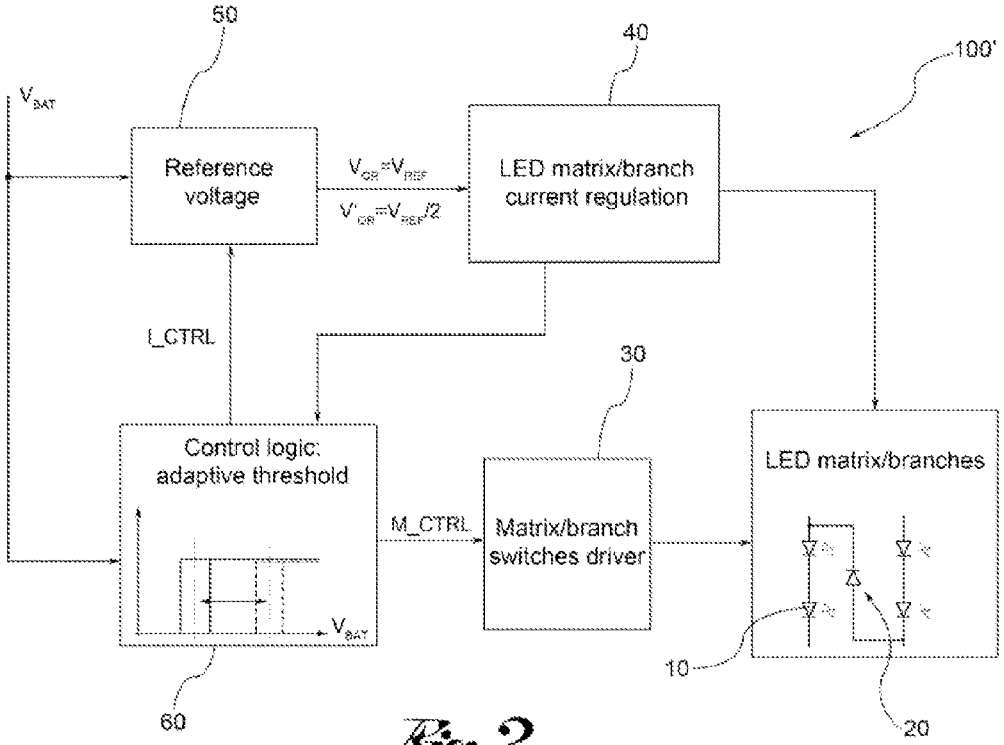
FIG. 2 is a block diagram of one embodiment of the driver circuit according to the invention.

In the embodiment shown in FIG. 1, Control logic is suitable for comparing the power supply voltage with a predefined threshold value. For example, the predefined threshold value is related to the product of the number of LEDs on the lighting branches and the junction voltage of each LED, bearing in mind a safety margin and applying an appropriate hysteresis. Consequently, when switching from the parallel configuration to the serial configuration is required, the number of LEDs on the lighting branches in the serial configuration is considered and, when the power supply voltage increases as far as exceeding the upper predefined threshold value, the "Control logic" block commands the "Reference voltage" block to reduce the driver voltage and commands the "Matrix/branch switches driver" to switch into the serial configuration.

Vice versa, when the power supply voltage is in the phase of decreasing from the nominal value, and switching from the serial configuration to the parallel configuration is therefore required, the previously defined threshold value is considered and, when the power supply voltage falls below the lower predefined threshold value, the "Control logic" block commands the "Reference voltage" block to increase the driver voltage and commands the "Matrix/branch switches driver" to switch into the parallel configuration.

It is evident that the lower the threshold value the better in that switching to the reduced consumption serial configuration takes place earlier.

Rather than using a predefined threshold value, in a preferred embodiment, the circuit 100' uses an adaptive threshold (FIG. 2) obtained by monitoring the effective state of the driver circuit. In particular, the control logic gets the information needed to calculate the adaptive threshold from the "LED matrix/branch current regulation" block 40. As will be described further below, the control logic is suitable for detecting the voltage drop at the terminals of at least one of the lighting switches 42 connected in cascade to the respective lighting branch/branches (the collector and emitter terminals in the case of lighting transistor) and to command the switch and the driver voltage regulator to pass from the series configuration to the parallel configuration when said voltage falls below a predefined threshold value. In this condition, in fact, the lighting transistor is about to pass from the linear zone to the saturation zone and will therefore no longer be able to regulate the current needed to turn on the lighting sources. It is therefore necessary to switch to the parallel configuration.

The control logic is also suitable for comparing the voltage drop at the terminals of at least one of the lighting switches 42 connected in cascade to the respective lighting branch/branches with the voltage drop at the ends of the respective lighting sources and to command the switch and the driver voltage regulator to pass from the parallel configuration to the serial configuration, depending on such comparison.

A first practical example of implementation of the block diagram in FIG. 2, that is to say with the adaptive threshold, will now be described with reference to the circuit implementation of FIGS. 3-3*d*.

In the example shown, the driver circuit is suitable for driving an LED matrix including 8 LEDs. According to the invention, the LED matrix may switch from a parallel configuration, in which it is formed of two rows and four columns of LEDs (from left to right: D10,D11; D1,D2; D6,D3; D13,D12) and a serial configuration, in which it is formed of four rows and two columns.

The LED matrix is connected between a power supply terminal VDD and the collector COLLECTOR of a lighting transistor Q1, which is part of the "Matrix current regulation" block 40.

The switch includes a first switching transistor Q10, connected between the third and fourth column of LEDs and the collector of the lighting transistor, a second switching transistor Q16, connected between the power supply terminal VDD and the first two columns of LEDs, and a diode, preferably a Schottky diode, connected between the cathodes of the third and fourth column of LEDs and the anodes of the first and second column of LEDs.

Figure 4:
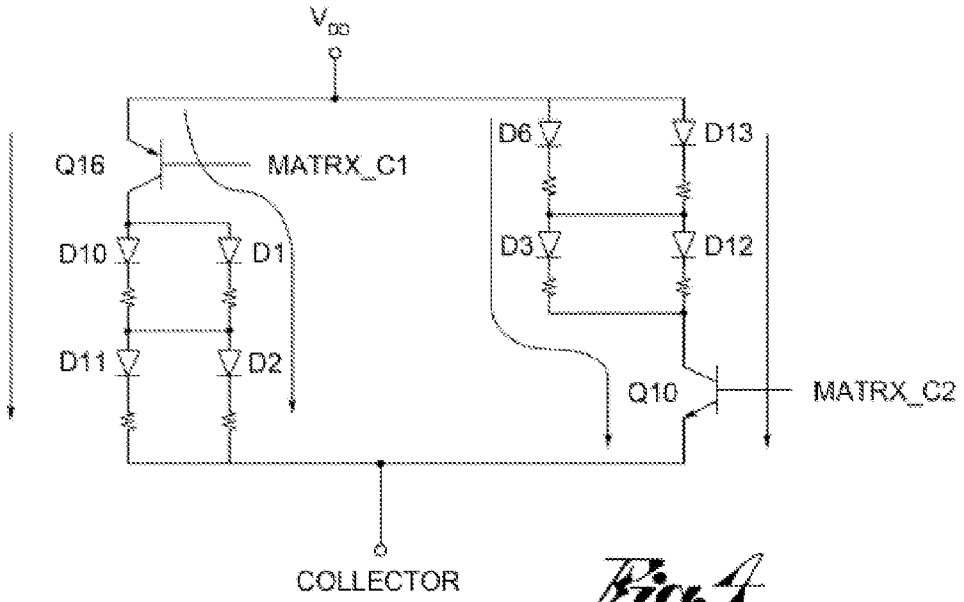
FIG. 4 shows the matrix of LEDs in FIG. 3, in the parallel configuration.

A starting situation in which both switching transistors Q10 and Q16 are on (FIG. 4) is considered. The four lighting branches are all in parallel with each other (if one ignores the VCE, SAT of the two switching transistors).

As soon as the switching transistors Q10 and Q16 are turned off, the collector voltage of the lighting transistor Q1 drops, in that said lighting transistor tries to keep the driver current constant and therefore lowers its resistivity between its collector and emitter terminals. As the collector voltage drops, the voltage at the ends of the LEDs of the first two columns (D1,D10,D2,D11) drops too, while the voltage at the anodes of the third and fourth columns remain constrained to VDD. This condition leads the switching diode D4 to be polarised in the direct zone and start conducting.

Figure 5:
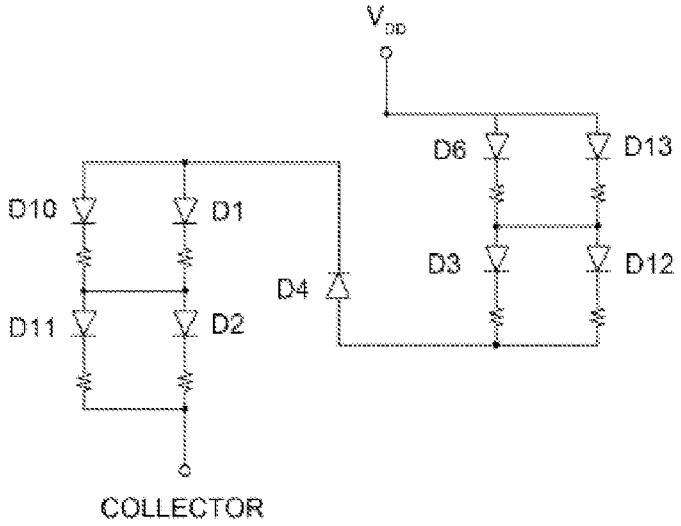
FIG. 5 shows the matrix of LEDs in FIG. 3, in the serial configuration.

After a brief transition, in which the luminosity drops but not visibly to the human eye, the matrix consequently moves into the "serial" configuration, that is of 4 rows×2 columns (FIG. 5).

In the inverse process, the switching transistors Q10 and Q16 turn on and constrain the anodes of the LEDs of the first two columns (D10,D1,D11,D2) to the voltage of the power supply terminal VDD; in the same way, the cathodes of the LEDs of the third and fourth column (D6,D13,D3,D12) are constrained to the voltage of the collector terminal COLLECTOR. As a result, the switching diode D4 turns off.

Moving on to the "Matrix current regulation" block 40, the lighting transistor Q1 is connected to a first operational amplifier U1 which imposes on the emitter EMITTER of the lighting transistor Q1, connected to the earth by the resistor R5, the driver voltage Vref'=2Vx or Vref"=Vx generated by the "Voltage reference" block 50, and, in particular, present on the output of a second operational amplifier U2 belonging to such block, the voltage Vx being, as will be explained below, a non-inverting input voltage of said second operational amplifier U2. This way, the driver current which runs through the LED matrix is known and stabilised.

The operational amplifiers U1 and U2 are used in feedback. So, the first operational amplifier U1 takes back the driver voltage Vref', Vref", which it has on its non-inverting input (+), on its inverting input (−), and therefore on the emitter EMITTER of the lighting transistor Q1.

The "Voltage reference" block 50 includes a zener diode D7 powered with a constant current. The voltage Vz at the ends of the zener diode D7 is therefore constant, regardless of the power supply voltage. A first stabilised voltage Vop used, for example, to power the operational amplifiers derives from said voltage Vz through the transistor Q2. Moreover, a second voltage Vx, which enters the non-inverting input of the second operational amplifier U2 in a constant manner, derives from the voltage Vz through the voltage divider R1, R18. The second operational amplifier U2 generates the driver voltage Vref'=2Vx, or Vref"=Vx, on its output, depending on the configuration of the feedback loop R21, R35, determined by the current control signal I_CTRL coming from the "Control logic" block 60.

The terminal relative to said signal I_CTRL is connected to the collector of the transistor Q18 of the "Control logic" block 60. The transistor Q18 works either on in saturation or off. When it is in saturation, its VCE,SAT may be considered almost null and the configuration of non-inverting amplifier is obtained for the second operational amplifier U2, with gain determined by the resistors R35, R21, in this case equal to 2.

When, instead, Q18 is off, the resistor R21 no longer counts and one has a follower configuration, achieving in output at the second operational amplifier Vref"=Vx.

The transistor Q18 is in turn commanded by a control signal STATUS which indicates in what state the LED matrix is, that is to say, in the serial configuration or in the parallel configuration.

Where the STATUS control signal comes from a bistable circuit 62, suitable for holding in its memory the state of the matrix of LEDs, as well as turning on and off the transistor Q18, the STATUS output of the bistable circuit 62 causes the turning on or off of another transistor Q7 of the "Control logic" block 60, suitable for generating the matrix control signal M_CTRL which, by means of the "Matrix switches driver" block 30, commands the transistors Q10 and Q16.

In the bistable circuit 62, the output signal is switched by the input signals status TO_LOWER and TO_UPPER, generated by respective differential circuits 64, 66 which compare voltages and determine, on the basis of such comparison, whether it is necessary to switch from one configuration to the other of the LED matrix. In particular, it may be observed how both differential circuits 64,66 have among their inputs the voltage VCQ1 on the collector terminal COLLECTOR of the lighting transistor Q1.

The differential lower threshold circuit 64 defines a lower threshold voltage VTHL as:

$$VTHL=VEQ1+VBEQ1*R6/(R4+R6);$$

where VEQ1 is the voltage on the emitter EMITTER terminal of the lighting transistor Q1 and where VBEQ1 is the voltage difference between the base terminal BASE and the emitter terminal EMITTER of said lighting transistor.

So, according to the differential circuit, if VCQ1<VTHL, then the output signal TO_LOWER is activated, inasmuch as crossed by current, and makes the bistable 62 and thereby the matrix of LEDs, change status.

The upper differential threshold circuit 66 defines an upper threshold voltage VTHH as:

$$VTHH=VEQ1+(VDD-VEQ1)*R40/(R39+R40);$$

where VDD is the voltage at the power supply terminal.

So, according to the differential circuit, if VCQ1>VTHH, then the output signal TO_UPPER is activated, inasmuch as crossed by current, and makes the bistable and thereby the matrix, change status.

In the case of the lower threshold differential circuit 64, the circuit realises that the lighting transistor Q1 is approaching saturation and that upon further lowering of the power supply voltage, such transistor will be unable to keep the LEDS on. It is therefore necessary to pass from the serial configuration to the parallel configuration. In practice, therefore, the lower threshold differential circuit 64 performs a comparison between the base voltage and the collector voltage of the lighting transistor.

As regards the lower threshold differential circuit 66, the passage from the parallel configuration to the serial configuration occurs when the voltage between the collector and emitter of the lighting transistor Q1 (plus a certain margin given by the drop on the elements making the matrix switch, plus a certain hysteresis with regard to the lower threshold VTHL) is almost equal to the drop on the lighting branch (VDD−VCQ1). In fact, passing from the parallel configuration to the serial configuration, the voltage drop on the lighting branches doubles, in that the matrix of LEDs passes from 2 to 4 rows. If there is an additional voltage drop between the collector and emitter of the lighting transistor Q1, this means that the matrix of LEDs can pass from the parallel configuration to the serial configuration.

In other words, in this condition, the lighting transistor Q1 may "surrender" its VCE to the matrix in serial configuration, without going into saturation.

Figure 6:
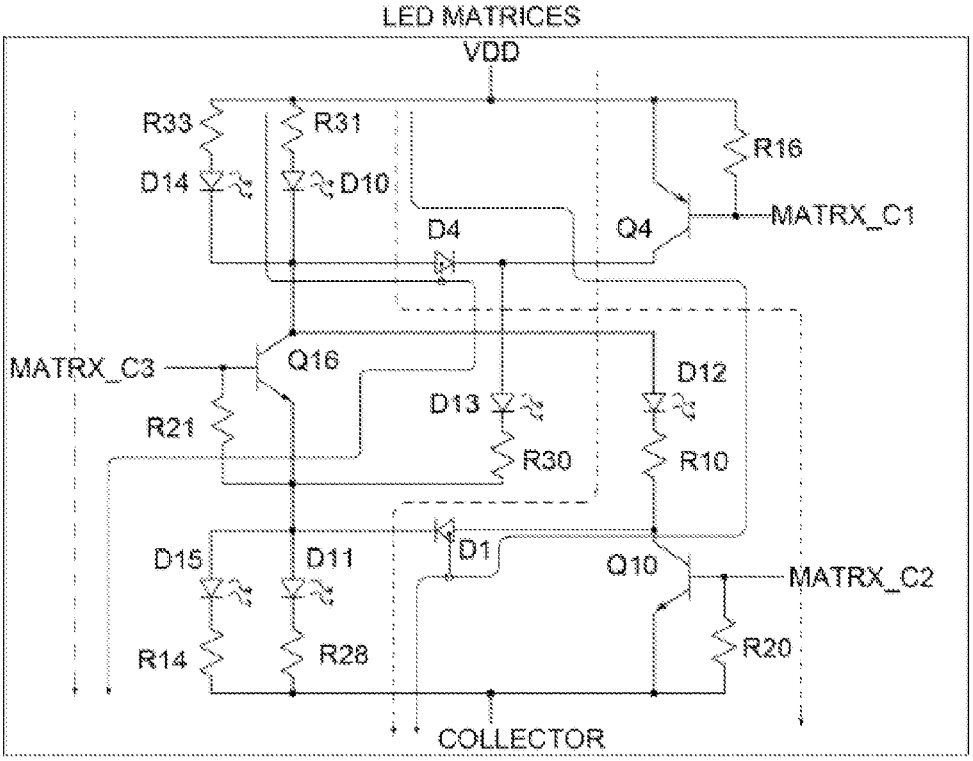
FIGS. 6 and 6*a* are circuit diagrams of another matrix of LEDs according to the invention.
Figure 6A:
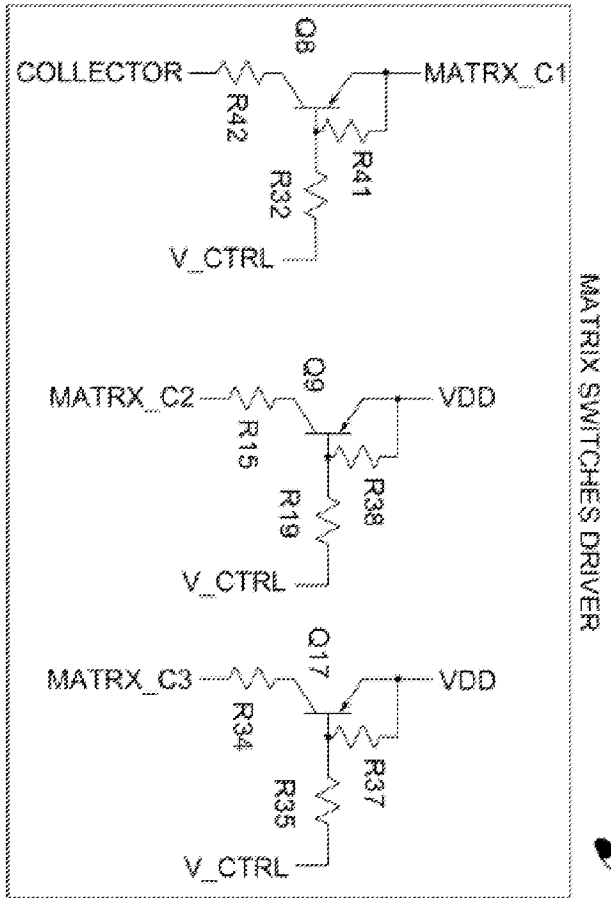

In another embodiment, shown in FIGS. 6 and 6*a*, the LED matrix in FIG. 6 comprises six LEDs and is able to switch between a parallel configuration of 2 rows by 3 columns, and a serial configuration of 3 rows by 2 columns, depending on the status of the switching transistors Q4, Q10 and Q16. FIG. 6 also shows the "Matrix switches driver" for the control of the switching transistors of the matrix of LEDs in FIG. 6. The remaining blocks of the driver circuit do not differ compared to the same blocks described above for the case of the 2-4 matrix of LEDs. As may be seen from the arrows in FIG. 6, showing the paths of the current in the two circuit configurations of use of the matrix, in a first configuration, which may be defined parallel, the matrix has three lighting branches, respectively including the pairs of LEDs D14,D15; D10,D12; and D13,D11. Such first configuration is obtained by turning on all the switching transistors Q4, Q10 and Q16 and with the switching diodes D1 and D4 denied access. In the second configuration, which may be defined serial, the matrix has two lighting branches, respectively comprising the LEDs D14, D13, D15 and D10, D12, D11. Such second configuration is obtained by turning off all three switching transistors and with the diodes D1 and D4 conducting. It is to be noted that in this case the two driver voltages are Vref'=Vx*3/2 and Vref"=Vx.

Figure 7A:
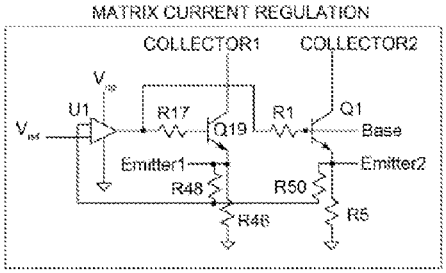
FIGS. 7, 7*a*, 7*b*, 7*c* and 7*d* are a circuit diagram of another matrix of LEDs according to the invention.
Figure 7B:
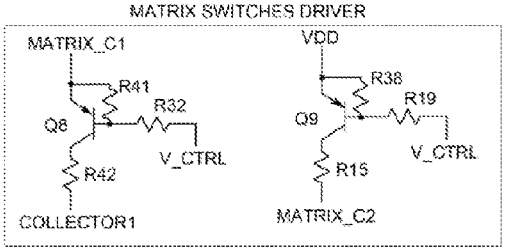
Figure 7:
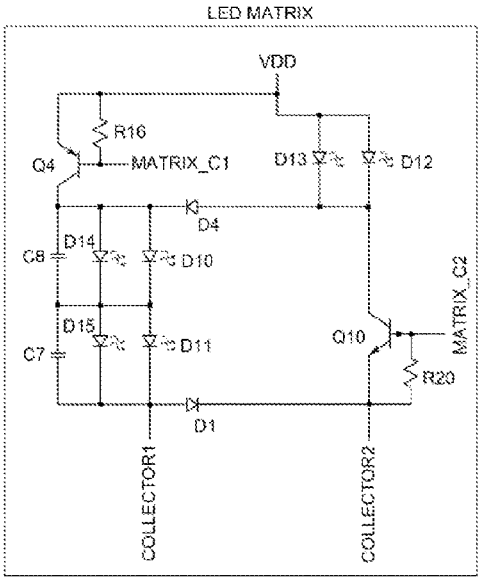
Figure 7C:
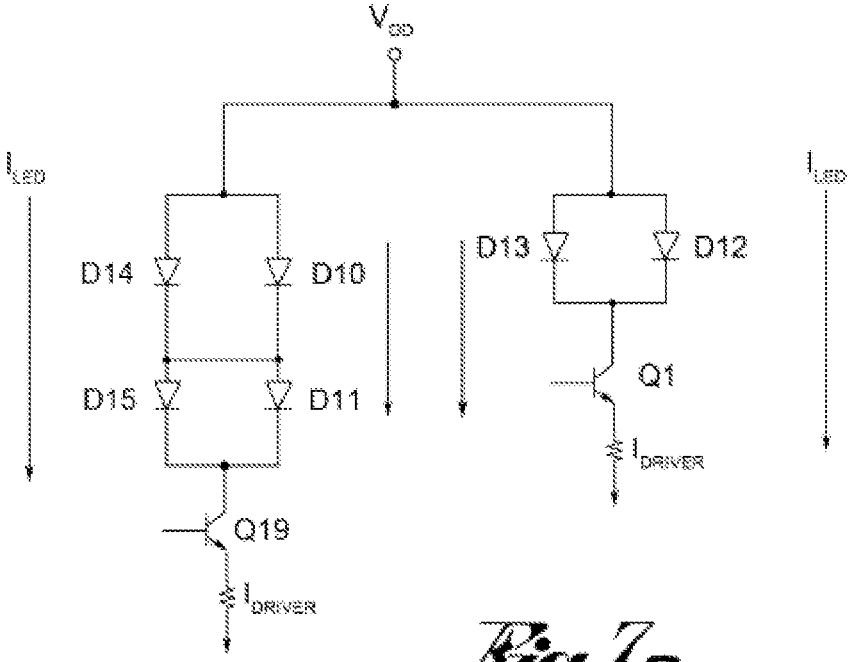
Figure 7D:
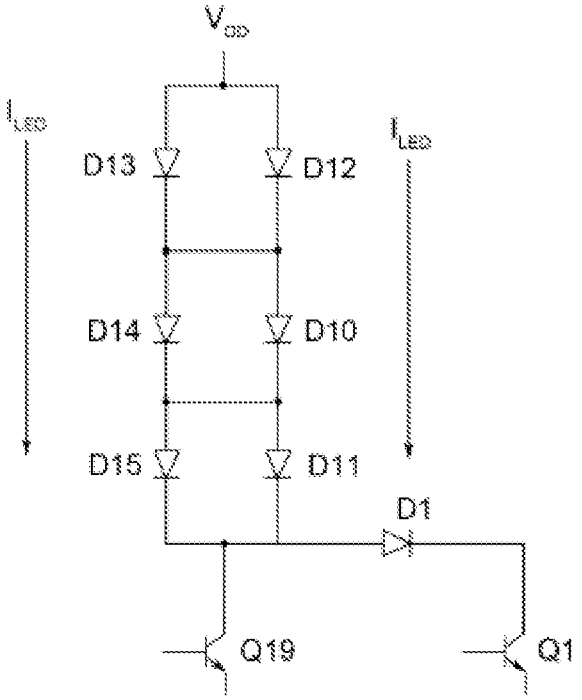

In another embodiment, shown in FIGS. 7-7*d*, the driver circuit has lighting branches in a matrix configuration. In particular, two lighting transistors are used, Q1 and Q19, each connected to a plurality of lighting sources according to the two "parallel-serial" configurations described now. The switching means comprise two switching transistors Q4 and Q10 and two switching diodes D1 and D4.

In a first configuration, which may be defined parallel, shown in FIG. 7*c*, the two switching transistors Q4 and Q10 are on and the two switching diodes D4 and D1 are denied access. In this state of the switch, the driver circuit presents a matrix of LEDs of two rows and two columns (LED D14, D10 and D15, D11), to which a first lighting transistor Q19 is connected, and a matrix of LEDs of one row and two columns (LED D13,D12), to which a second lighting transistor Q1 is connected, In practice, therefore in this parallel configuration, there are four lighting branches according to the definition given above of lighting branch.

In a second configuration, which may be defined a serial configuration, shown in FIG. 7*d*, the two switching transistors Q4 and Q10 are off and the two switching diodes D4 and D1 are directly polarised, that is to say conducting. In this state of the switching means, the driver circuit presents a matrix of LEDs of three rows and two columns, to which the collectors of both lighting transistors Q19 and Q1 are connected, connected to each other by the switching diode D1. In practice, therefore in this parallel configuration, there are two lighting branches according to the definition given above of lighting branch.

FIGS. 7*a* and 7*b* show a circuit implementation of the "Matrix current regulation" block, in this case comprising the two lighting transistors Q1 and Q19 and the "Matrix switches driver" for the control of the two switching transistors of the matrix of LEDs in FIG. 7. The remaining blocks of the driver circuit do not differ compared to the same blocks described above for the case of the 2-4 matrix of LEDs.

Figures 8, 8A:
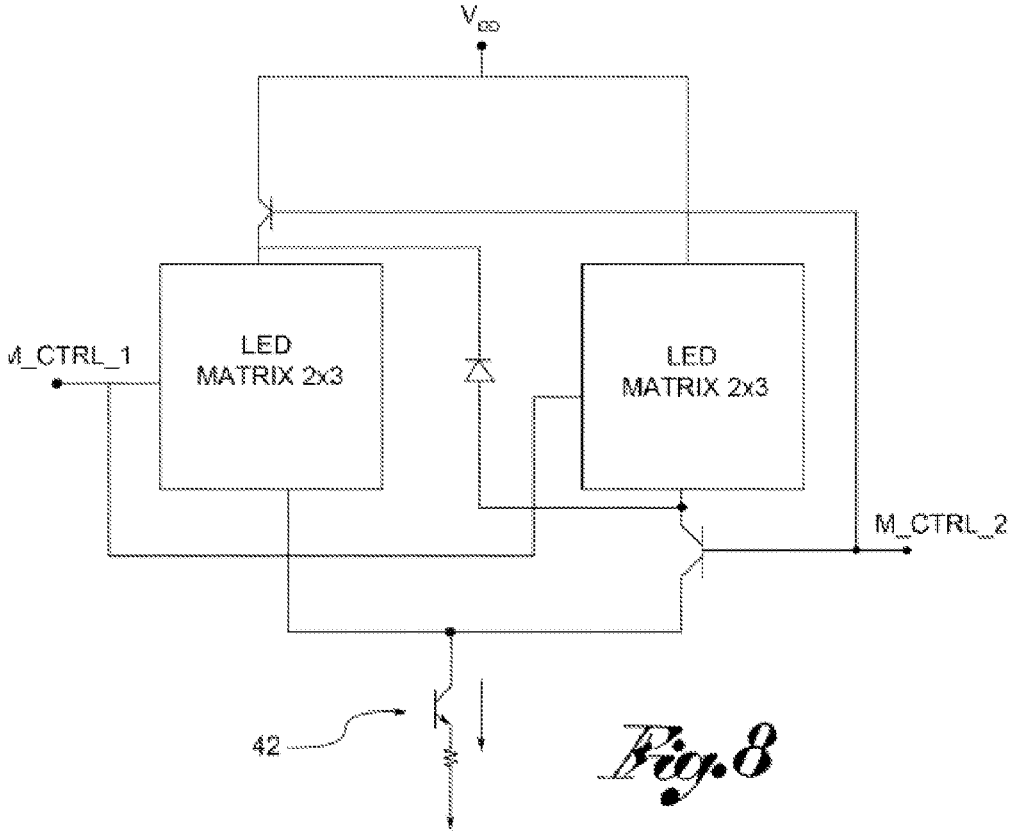
FIGS. 8 and 8*a* are a table of the states of the control signals for the matrix in FIG. 7.

In a further embodiment, shown in FIGS. 8, 8*a*, two 2×3 matrices, as shown in FIG. 6, are connected between the power supply terminal VDD and the collector of a lighting transistor 42, as shown in FIG. 8. Depending on the status of the control signal M_CTRL_1, these matrices may pass from a two row configuration of LEDs per lighting branch, to a status of three rows of LEDs per lighting branch. Depending on the status of the control signal M_CTRL_2, rather, the two matrices may be connected in series or in parallel to each other. The combined effect of changing the status of the signals M_CTRL_1 and M_CTRL_2 therefore permits four different circuit combinations to be obtained, as described in the table in FIG. 8*a*, with a number of rows of LEDs per lighting branch which may be equal to 2, 3, 4 or 6. These four configurations or levels, are separated by three thresholds. In the passage from one configuration to another, at each increase in the number of rows of LEDs per lighting branch, there is a respective drop in the number of columns, to the benefit of a saving of the absorbed power.

It is to be noted moreover, that the present invention is equally applicable in the case in which the driver circuit is not current stabilised. For example, the reference voltage Vx is not constant but depends on the power supply voltage VDD, according to the relation $$Vx=VA+k*VDD, \text{ for } K*VDD>VA,$$

where VA is a constant voltage.

An example of such driver circuit is described in the patent application PD2011A000371, which has yet to be published. The driver current being dependent on the power supply voltage VDD, it is possible, when the power supply voltage exceeds the nominal value, to apply a dynamic PWM modulation to it, so as to dissipate less power compared to the current stabilised circuit.

Figure 3B:
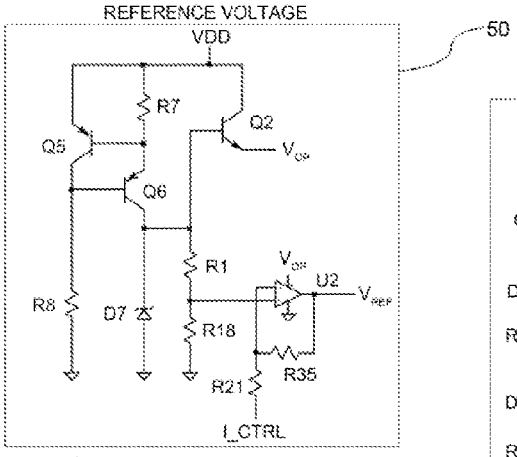
FIGS. 3, 3*a*, 3*b*, 3*c* and 3*d* are a circuit implementation of the functional blocks of the block diagram illustrated in FIG. 2.
Figure 3:
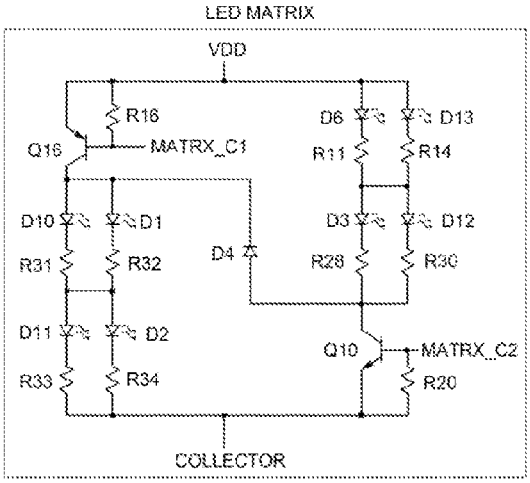
Figure 3A:
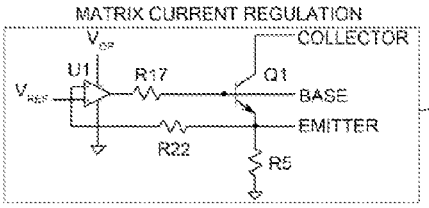
Figures 3C, 3D:
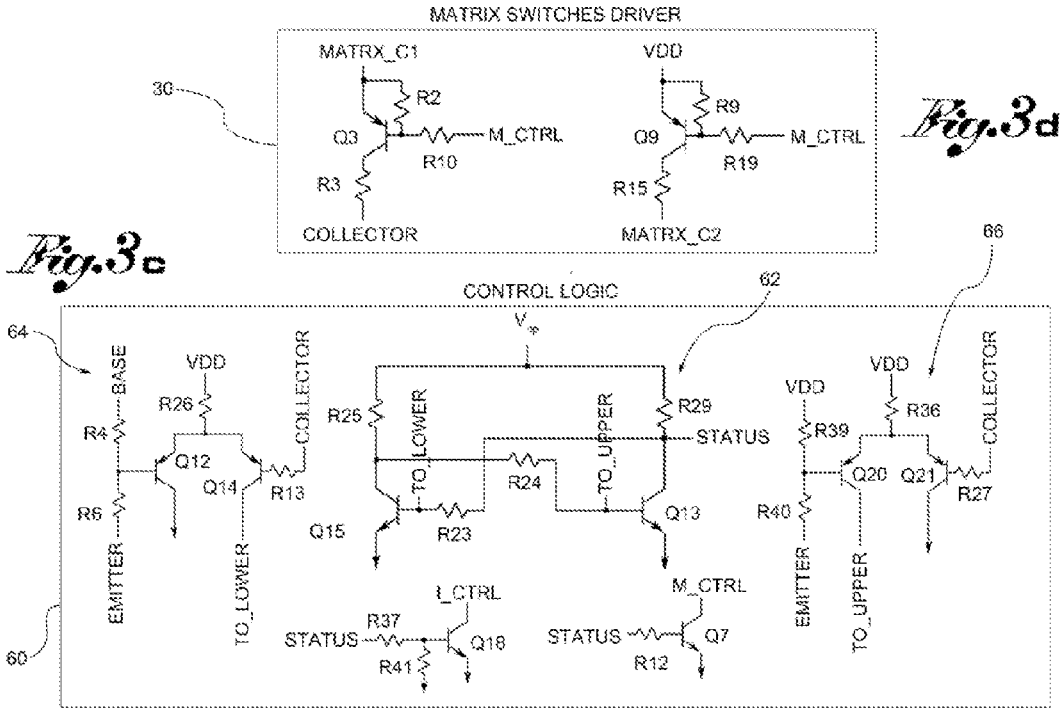

In this case, in the preferred circuit implementation shown in FIGS. 3-3*d* we will have, simply $$Vref'=2*(VA+k*VDD) \text{ for } k*VDD>VA$$

$V_{ref}''=VA+K*VDD.$

Figure 9:
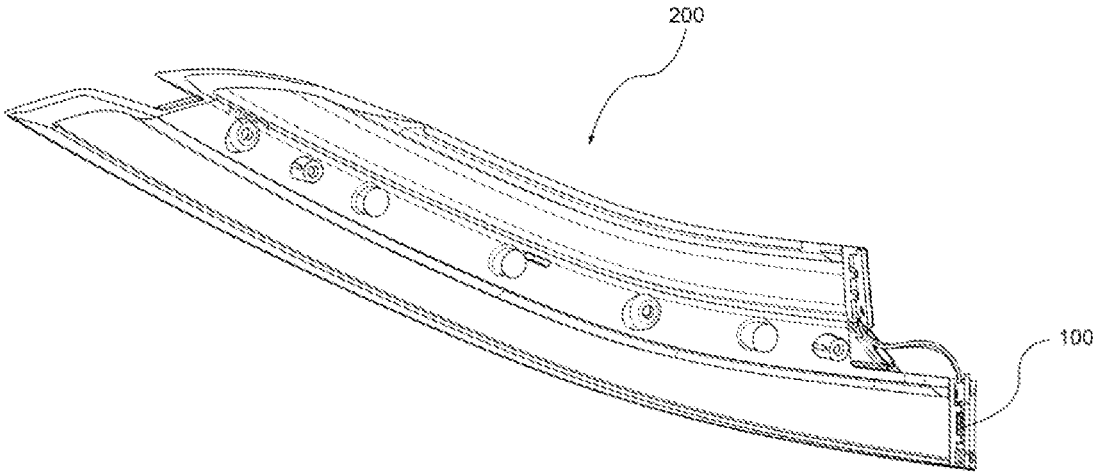
FIG. 9 is an example of a vehicle light in which the LEDs are driven by a driver circuit according to the invention.

With reference to FIG. 9, the present invention relates to a vehicle light 200 wherein at least one light of the vehicle light is made with LED light sources driven by the driver circuit described above. The vehicle light 200 may be a front, rear or brake light of the vehicle and, for example, a light of the rear light may be a sidelight, brake light or fog light.

A person skilled in the art may make modifications and adaptations to the embodiments of the driver circuit according to the invention, replacing elements with others functionally equivalent so as to satisfy contingent requirements while remaining within the scope of protection of the following claims.

For example, the control circuit may be implemented in a software, for example, using a micro controller processing unit or a DSP, to obtain the control signal as described above.

Each of the characteristics described as belonging to a possible embodiment may be realised independently of the other embodiments described.

The invention claimed is:

1. A driver circuit of lighting sources for powering a plurality of light sources, wherein the lighting sources are positioned on lighting branches, where each lighting branch comprises lighting sources connected in series to each other or lighting sources belonging to a column of a matrix of lighting sources, said driver circuit including a power supply terminal in electrical communication with a direct voltage power supply generator, and a switch that is operated depending on the value of said direct voltage power supply to switch the path of the overall power supply electric current between at least one first path, corresponding to a first circuit configuration of the interconnections between the lighting sources, and at least one second path, corresponding to a second circuit configuration of the interconnections between the lighting sources, said at least two circuit configurations having a different number of lighting branches, wherein the number of lighting sources supplied by the overall supply electrical current is kept constant, and wherein the branch current flowing through each lighting branch is unchanged as said configuration varies.

2. The circuit according to claim 1, wherein said switch can be operated to connect at least two lighting branches alternately in parallel or in series.

3. The circuit according to claim 1, wherein said switch can be operated to connect at least two branches of a first configuration of lighting branches, or parallel configuration, so as to obtain a second configuration, or series configuration, having a reduced number of lighting branches, and vice versa.

4. The circuit according to claim 1, wherein said switch can be operated to connect the lighting sources of a lighting branch alternately in parallel or in series with the lighting sources of the other lighting branches.

5. The circuit according to claim 1, wherein said switch can be operated to connect lighting sources of a lighting branch of a first configuration, or parallel configuration, respectively to further lighting branches of said first configuration, so as to obtain a second configuration, or series configuration, having a reduced number of lighting branches, and vice versa.

6. The circuit according to claim 1, including a control circuit suitable for comparing the power supply voltage with at least one predefined threshold value and for commanding the switch and the driver voltage regulator depending on such comparison.

7. The circuit according to claim 1, further including a control circuit suitable for detecting the voltage drop at the terminals of at least one lighting switch connected in series to at least one respective lighting branch and to command said switch and the driver voltage regulator to pass from the series configuration to the parallel configuration when said voltage falls below a predefined threshold value.

8. The circuit according to claim 1, further including a control circuit suitable for comparing the voltage drop at the terminals of at least one lighting switch connected in series to at least one respective lighting branch with the voltage drop at the ends of said respective lighting branch and to command said switch and the driver voltage regulator to pass from the first configuration or parallel configuration, to the second configuration, or series configuration, depending on such comparison.

9. The circuit according to claim 1, wherein said switch comprise changeover switches which, when in a conductive state, are suitable for connecting the lighting branches in a first configuration, or parallel configuration, and at least one switch diode element which when said changeover switches are in a cut-off state, is suitable for connecting the lighting branches in a second configuration or series configuration.

10. The circuit according to claim 1, wherein the lighting sources are connected to a power supply terminal (VDD) connectable to a direct voltage power supply generator (Vbat).

11. The circuit according to claim 10, wherein said switch can be operated depending on the value of said direct voltage power supply.

12. The circuit according to claim 11, wherein the driver voltage (Vx) depends on the power supply voltage VDD, according to the relation $$Vx=VA+k*VDD, \text{ for } K*VDD>VA,$$

where VA is a constant voltage and K is a factor.

13. The circuit according to claim 1, comprising at least one lighting switch connected at least to a respective lighting branch and operable to impose a branch current (ILED) through said lighting branch required by the lighting sources to provide the desired luminosity.

14. The circuit according to claim 13, wherein each lighting switch imposes a driver current (IDRIVER) depending on a driver voltage (Vref) applied to said lighting switch.

15. The circuit according to claim 14, wherein said driver voltage (Vref) is constant.

16. The circuit according to claim 13, including a driver voltage regulator, suitable for regulating the driver voltage value according to the first or second configuration of the lighting branches so as to maintain the branch current (ILED) unchanged as said configuration varies.

17. The circuit according to claim 13, comprising at least two LED matrixes connected between the power supply terminal (VDD) and the collector (42) of a lighting transistor, a first switch which can be operated to switch the circuit configuration of each of said matrixes from a first configuration of n rows and m columns to a second configuration of m row and n columns, or vice versa, and a second switch which can be operated to connect said matrixes to each other alternately in series or parallel to each other, so as to obtain at least four different circuit configurations.

18. The circuit according to claim 17, wherein said first and second switches can be operated depending on a comparison between the collector voltage of the lighting transistor and at least two threshold values.

19. A method of driving lighting sources for powering a plurality of light sources, wherein the lighting sources are positioned on lighting branches, where each lighting branch comprises lighting sources connected in series to each other or lighting sources belonging to a column of a matrix of lighting sources, and wherein the light sources are powered by a direct voltage power supply generator, comprising the steps of:

sensing the value of the direct voltage power supply, depending on the value of the direct voltage power supply, switching the path of the overall power supply electric current between at least one first path, corresponding to a first circuit configuration of the interconnections between the lighting sources, and at least one second path, corresponding to a second circuit configuration of the interconnections between the lighting sources, said at least two circuit configurations having a different number of lighting branches, keeping the number of lighting sources supplied by said overall supply electrical current constant, and wherein the branch current flowing through each lighting branch is unchanged as said configuration varies.

20. The method according to claim 19, wherein said modifying step is performed depending on the value of the direct voltage power supply of the lighting sources.

21. The method according to claim 19, wherein at least one lighting switch is connected at least to a respective lighting branch to impose a branch current (ILED) through said lighting branch required by the lighting sources to provide the desired luminosity, and wherein each lighting switch imposes a driver current (IDRIVER) depending on a driver voltage (Vref) applied to said lighting switch, the method comprising the step of regulating the value of said driver voltage depending on the configuration assumed by the lighting branches so as to maintain the branch current (ILED) unchanged as said configuration varies.

22. The method according to the claim 21, wherein the steps of modifying the path of the power supply current and regulating the driver voltage are performed as a result of a comparison step of the power supply voltage with at least one predefined threshold value.

23. The method according to claim 21, comprising a step of detecting the voltage drop at the terminals of the lighting switch connected in series to at least one respective lighting branch, the steps of modifying the path of the power supply current to increase the number of lighting branches and of regulating the driver voltage being performed when said voltage drop falls below a predefined threshold value.

24. The method according to claim 21, comprising a step of comparing the voltage drop at the terminals of the lighting switch connected in series to at least one respective lighting branch, with the voltage drop at the ends of said respective lighting branch, the steps of modifying the path of the power supply current to reduce the number of lighting branches and regulating the driver voltage being performed consequent to such comparison.

* * * * *